US007039333B2

(12) United States Patent
Do

(10) Patent No.: US 7,039,333 B2
(45) Date of Patent: May 2, 2006

(54) DEVELOPING DEVICE HAVING DEVELOPING GAP DETECTING FUNCTION

(75) Inventor: Ki-jae Do, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 159 days.

(21) Appl. No.: 10/635,901

(22) Filed: Aug. 7, 2003

(65) Prior Publication Data

US 2004/0071477 A1 Apr. 15, 2004

(30) Foreign Application Priority Data

Aug. 7, 2002 (KR) ..... 2002-46644
Mar. 26, 2003 (KR) ..... 10-2003-0018820

(51) Int. Cl.
*G03G 15/08* (2006.01)
*G03G 15/00* (2006.01)
*G03G 15/06* (2006.01)

(52) U.S. Cl. ..... 399/53; 399/46; 399/55

(58) Field of Classification Search ..... 399/46, 399/53, 55, 222, 285
See application file for complete search history.

(56) References Cited

U.S. PATENT DOCUMENTS 5,315,353 A * 5/1994 Simazaki et al. ..... 399/53
5,400,120 A * 3/1995 Narazaki et al. ..... 399/46 X
5,521,683 A * 5/1996 Miyamoto et al. ..... 399/55
5,983,044 A * 11/1999 Kodama et al. ..... 399/55 X

* cited by examiner

*Primary Examiner*—Sandra L. Brase
(74) *Attorney, Agent, or Firm*—Staas & Halsey LLP

(57) ABSTRACT

A developing device having a developing gap detecting function includes a photosensitive medium, a developer conveyer, a DC power source, an AC power source, a current detecting unit and a controller. The current detecting unit detects a DC current flowing on the developer conveyer when toner from the developer conveyer is attached to a desired area of an electrostatic latent image on a photosensitive body by enhancing a voltage outputted from a power supply gradually at proper intervals. The controller obtains a developing gap between the photosensitive medium and the developer conveyer based on current values detected by the current detecting unit. In accordance with the developing device having the developing gap detecting function, the developing gap is sensed and developing voltage is easily and correctly calculated to control image forming conditions. As a result, an image quality improves.

14 Claims, 6 Drawing Sheets

DEVELOPING DEVICE HAVING DEVELOPING GAP DETECTING FUNCTION

CROSS-REFERENCE TO RELATED APPLICATIONS

This application claims the benefit of Korean Patent Application No. 2002-46644, filed Aug. 7, 2002, in the Korean Intellectual Property Office, and Korean Patent Application No. 2003-18820 filed Mar. 26, 2003, the disclosures of which are incorporated herein by reference.

BACKGROUND OF THE INVENTION

1. Field of the Invention

The present invention relates to an image forming apparatus for developing an electrostatic latent image formed on a photosensitive medium, such as a photosensitive drum, into a toner image in office machines, such as a laser beam printer, a facsimile, a digital copier, etc., employing an electrophotograph method, and more particularly, to an image forming apparatus having a developing gap detecting function capable of correctly detecting a developing gap between a photosensitive medium and a developer conveyer, such as a developing roller, at a low cost.

2. Description of the Related Art

FIG. 1 is a view schematically showing a general developing device. Referring to FIG. 1, the developing device includes a photosensitive medium 1 (hereinafter, called a photosensitive drum) forming an electrostatic latent image or electrostatic latent images by a laser scanning unit (LSU), not shown, using a voltage level property of a surface thereof, a charged roller 2 applying an electrical property to the surface of the photosensitive drum 1 while rotating to be in contact with the photosensitive drum 1, a developer conveyer 5 (hereinafter, called a developing roller) depositing a developer (toner) which includes desired colors of toner to the electrostatic latent image formed on the photosensitive drum 1 while rotating in a direction opposite to the photosensitive drum 1 to form a visible image, a developer supplying roller 6 supplying the developer to the developing roller 5, a developer amount regulating member 7 regulating an amount of a developer layer of the developer deposited on the developing roller 5, a cleaning blade 10 removing a residual developer remaining on the surface of the photosensitive drum 1 after one period of rotation of the photosensitive drum 1, and a power supply supplying a supply voltage to the photosensitive drum 1, the developing roller 5, and the developer amount regulating member 7.

An operation of the image forming apparatus having the above-mentioned developing device is described as follows. Firstly, the surface of the photosensitive drum 1 is charged uniformly to a desired voltage by the charged roller 2.

Thereafter, the LSU converts digital signals inputted from a computer or a scanner through a laser diode into a laser beam in a form of optical signals and emits the laser beam to the photosensitive drum 1, thereby forming the electrostatic latent image on the surface of the photosensitive drum 1.

The developer supplied on a surface of the developing roller 5 is moved in a developing gap g formed between the photosensitive drum 1 and the developing roller 5 through a rotation of the developing roller 5. At this time, the developer is maintained in a desired developer (toner) thickness on the surface of the developing roller 5 by the developer amount regulating member 7 mounted in an upper part of the developing roller 5.

Thereafter, during a rotation of the photosensitive drum 1, the developer is moved to the electrostatic latent image of the photosensitive drum 1 by a voltage level difference between the electrostatic latent image on the photosensitive drum 1 and the surface of the developing roller 5, and the electrostatic latent image formed on the surface of the photosensitive drum 1 is developed to a visual form of a toner image (visual image).

If a sheet of paper is fed between the photosensitive drum 1, on which the toner image is formed, and a transfer roller (not shown) located under the photosensitive drum 1. The transfer roller generates a high voltage of air discharge to transfer the toner image deposited on the photosensitive drum 1 onto the sheet.

Thereafter, the photosensitive drum 1 continues to rotate, and the cleaning blade 10 removes the developer remaining on the surface of the photosensitive drum 1 to enable the photosensitive drum 1 to form a next electrostatic latent image or next electrostatic latent images. At this time, the sheet to which the toner image is transferred, is fixed by heat and pressure and then discharged out of a machine. Accordingly, a series of image formation processes is ended (completed).

However, it is important for this image forming apparatus to uniformly keep the developing gap g between the photosensitive drum 1 and the developing roller 5 to maintain a developing quality uniformly and stably in an operation of depositing the developer on the electrostatic latent image of the photosensitive drum I to develop the toner image.

In order to achieve this goal, as shown in FIG. 2, the developing device 1 includes a spacer 5*a* having two spacer rolls as a device for maintaining the uniform developing gap g between the photosensitive drum 1 and the developing roller 5, wherein the two spacer rolls are capable of rotating to be in contact with the surface of the photosensitive drum 1 at both ends of a shaft 5*b* of the developing roller 5.

Since the spacer 5*a* has a greater external diameter to form a desirable developing gap g with the photosensitive drum 1 than an external diameter of the developing roller 5, when the photosensitive drum 1 and the developing roller 5 are disposed opposite to each other with respect to the developing gap g and rotated at a uniform linear velocity by a photosensitive drum gear 1*a* and a developing roller gear 5*c*, the developing gap 9 between the developing roller 5 and the photosensitive drum 1 is always maintained uniform. As shown in FIG. 3, the developing gap g is expressed by a formula (D2–D1)/2–(D4–D3)/2 wherein D1 is an external diameter of the developing roller 5, D2 is an external diameter of the spacer 5*a* , D3 is an external diameter of the shaft 5*b*, and D4 is an internal diameter of the spacer 5*a*.

However, in respective developing devices, the developing gap varies depending on measurement precisions of related parts. Image qualities also vary in accordance with variations of the developing gaps. With a large developing gap, a developing electric field becomes weaker, and accordingly, an image density is lowered. On the other hand, with a smaller developing gap, the developing electric field becomes stronger, and accordingly, the image density becomes higher. In a worse case, there can be a discharge inducing an image noise. Accordingly, to solve such a problem, it is required to precisely install the developing device in the image forming apparatus, sense the developing gap of the developing device upon printing, adjust the developing electric field appropriately according to a sensed result, and outputting the variable electric field.

For this purpose, a technology for forming reference images on a photosensitive medium or a transfer belt and detecting an image concentration using an optical sensor has been disclosed. However, this conventional technology has a disadvantage that due to a high cost of the optical sensor, the production cost increases.

Additionally, U.S. Pat. No. 5,521,683 discloses an apparatus for detecting a developing gap by applying a constant voltage and a constant current to a developing conveyer. However, this reference has a disadvantage that a voltage and current variation corresponding to the variation of the developing gap is too small, and thus becomes inaccurate.

SUMMARY OF THE INVENTION

Therefore, the present invention has been made to solve the above and/or other problems, and it is an aspect of the present invention to provide a developing device having a developing gap detecting function capable of correctly detecting a developing gap between a developing roller and a photosensitive drum at low cost.

Additional aspects and advantages of the invention will be set forth in part in the description which follows and, in part, will be obvious from the description, or may be learned by practice of the invention.

According to the above and/or other aspects of the present invention, an image forming apparatus having a developing gap detecting function includes a photosensitive medium forming an electrostatic latent image, a developer conveyer depositing a developer to the electrostatic latent image formed on the photosensitive medium to form a visual image while rotating the photosensitive medium opposite thereto, a power supply supplying one of DC voltage and the DC voltage overlapped with AC voltage to the developer conveyer, a current detecting unit detecting a value of a DC current flowing on the developer conveyer when the voltage of the power supply is outputted, and a controller obtaining a developing gap formed between the photosensitive medium and the developer conveyer based on the DC current value detected by the current detecting unit.

According to another aspect of the invention, when the electrostatic latent image formed on the area of the photosensitive medium is developed using the developer transferred from the developer conveyer, the current detecting unit detects the DC current flowing on the developer conveyor.

The controller calculates a developing voltage adapted to the developer conveyer based on the obtained developing gap and supplies the developing voltage to the developer conveyer.

Additionally, the Image forming apparatus further comprises a voltage detecting circuit detecting the AC voltage from the DC voltage overlapped with AC voltage, and a constant voltage control circuit which feeds-back a value of the detected AC voltage to the power supply to maintain the value of the detected AC voltage as a target voltage value for developing. Further, the controller controls the constant voltage control circuit to output the developing voltage adapted to the developer conveyer.

Based on the obtained developing voltage, the controller controls image forming conditions including a charged voltage for charging the photosensitive medium and a magnitude of light and a scanning time of the exposure member forming the electrostatic latent image on the photosensitive medium using the light.

After the developing gap is obtained, the controller controls such that a toner image, which is developed on certain area of the photosensitive medium by the developing of the electrostatic latent image with the developer for the purpose of obtaining the developing gap, is transferred onto a paper sheet as fed.

According to another aspect of the present invention, a developing gap detecting apparatus Includes a photosensitive medium forming an electrostatic latent image, a developer conveyer depositing a developer to the electrostatic latent image formed on the photosensitive medium to form a visual image while rotating the photosensitive medium opposite thereto, a power supply supplying one of DC voltage and the DC voltage overlapped with AC voltage to the developer conveyer, a current detecting unit detecting a value of a DC current flowing on the developer conveyer when the voltage of the power supply is outputted, and a controller obtaining a developing gap formed between the photosensitive medium and the developer conveyer based on the DC current value detected by the current detecting unit.

According to yet another aspect of the present invention, an image forming apparatus having a developing gap detecting function includes a photosensitive medium, an exposure member forming an electrostatic latent image on the photosensitive medium, a developer conveyer depositing a developer to the electrostatic latent image formed on the photosensitive medium to form a visual image, a power supply supplying a voltage to the photosensitive medium and the developer conveyer, a current detecting unit detecting a current flowing from the power supply to the developer conveyer when the voltage of the power supply is outputted to develop the electrostatic latent image using the developer, and a controller controlling one of a peak-to-peak, a duty ratio, a frequency, and a DC overlapped value of an AC voltage component of the power source to control image forming conditions of the developing device, and adjusting the voltage to charge the photosensitive medium, strength of light and a scanning time of the exposure member forming the electrostatic latent image on the photosensitive medium using the light.

According to yet another aspect of the present invention, a developing gap detecting method in an image forming apparatus having a photosensitive medium and a developer conveyer, includes supplying one of DC voltage and the DC voltage overlapped with AC voltage to the photosensitive medium and the developer conveyer, detecting a value of a DC current flowing on the developer conveyer when a predetermined voltage is outputted to develop an electrostatic latent image formed on an area of the photosensitive medium using a developer transferred from the developer conveyer, obtaining a developing gap formed between the photosensitive medium and the developer conveyer based on the detected DC current value, and calculating a developing voltage adapted to the developer conveyer to be supplied to the developer conveyer based on the obtained developing gap.

According to yet another aspect of the present invention, a developing gap detecting method in an image forming apparatus having a photosensitive medium and an exposure member forming an electrostatic latent Image on the photosensitive medium, includes controlling one of a peak-to-peak, a duty ratio, a frequency, and a DC overlapped value of an AC voltage component of an AC power source supplying a voltage to the developing device to control Image forming conditions of the developing device, and adjusting a charged voltage to charge the photosensitive medium, strength of light and a scanning time of the exposure member forming the electrostatic latent image on the photosensitive medium using the light.

BRIEF DESCRIPTION OF THE DRAWINGS

These and/or other aspects and advantages of the invention will become apparent and more readily appreciated from the following description of the preferred embodiment, taken in conjunction with the accompanying drawings of which.

DETAILED DESCRIPTION OF THE PREFERRED EMBODIMENTS

Figure 1:
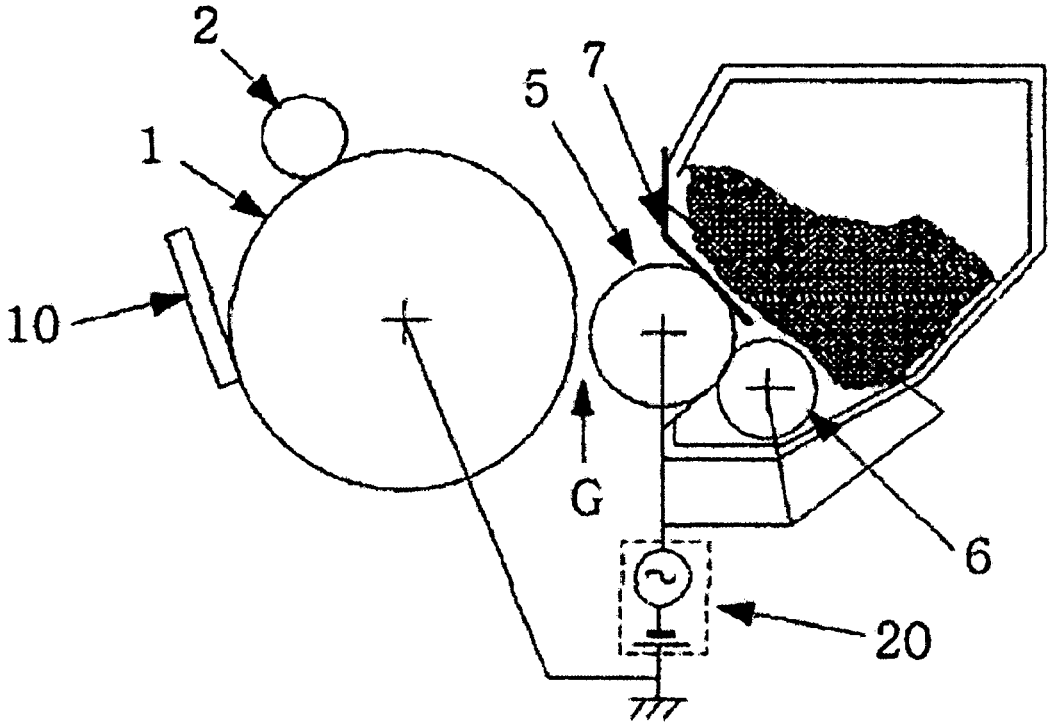
FIG. 1 (PRIOR ART)
FIG. 1 is a view schematically showing a general developing device of an image forming apparatus.
Figure 2:
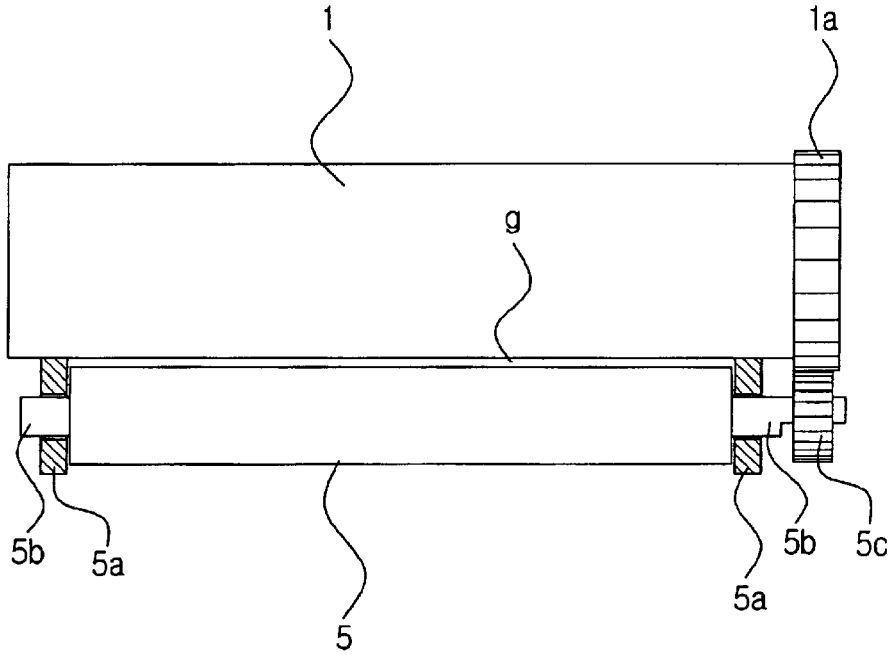
FIG.2 (PRIOR ART)
FIG. 2 is a front view of a developing gap holding device of a conventional image forming apparatus shown in FIG. 1.
Figure 3:
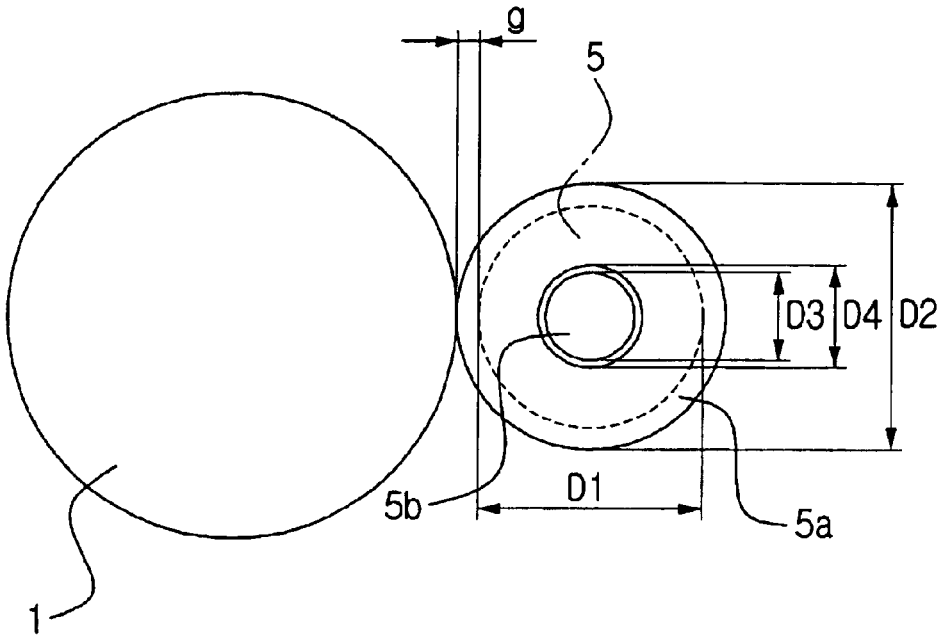
FIG.3 (PRIOR ART)
FIG. 3 is a side view of the developing gap holding device shown in FIG. 2.

Reference will now be made in detail to the present preferred embodiment of the present invention, examples of which are illustrated in the accompanying drawings, wherein like reference numerals refer to the like elements throughout. The embodiment is described in order to explain the present invention by referring to the Figures.

A detailed description of a developing device according to an embodiment of the invention will be described with reference to the accompanying drawings.

Figure 4:
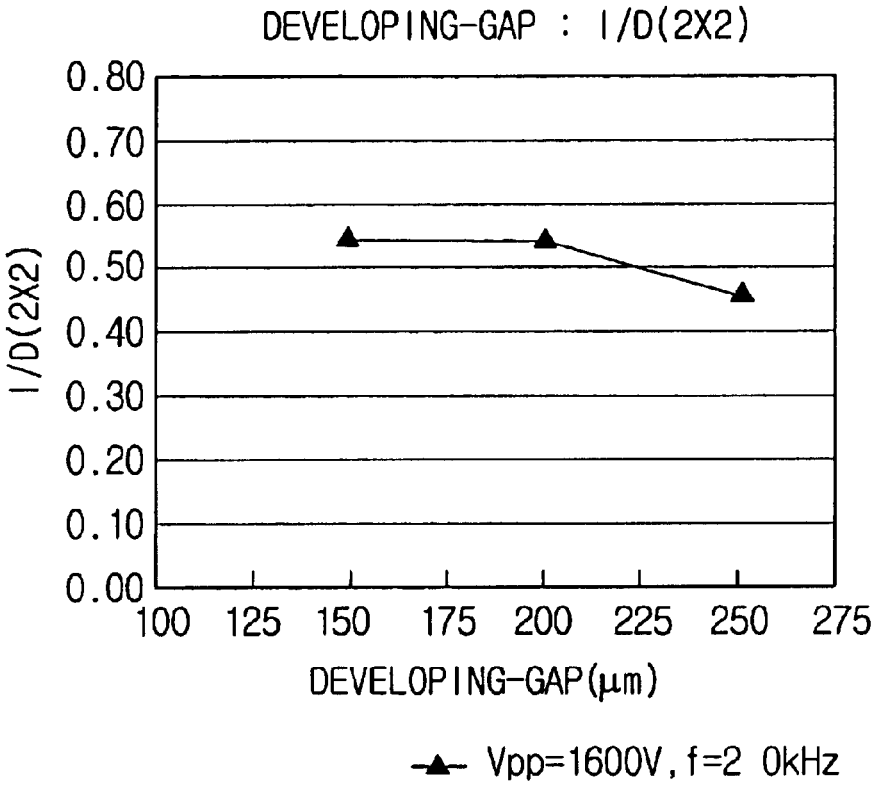
FIG. 4 is a graph representing image variations corresponding to a developing gap.

FIG. 4 is a graph representing image variations corresponding to a developing gap. As shown in FIG. 4, when the developing gap becomes greater due to a variation of an image density, an image quality becomes lowered. Accordingly, to obtain a uniform quality of an image, it is necessary to maintain an appropriate developing gap. Also, the variation of the image density and a line width of the image are prevented, and a current leakage is avoided by adjusting image forming conditions according to the variation and a difference of developing gaps.

Figure 5:
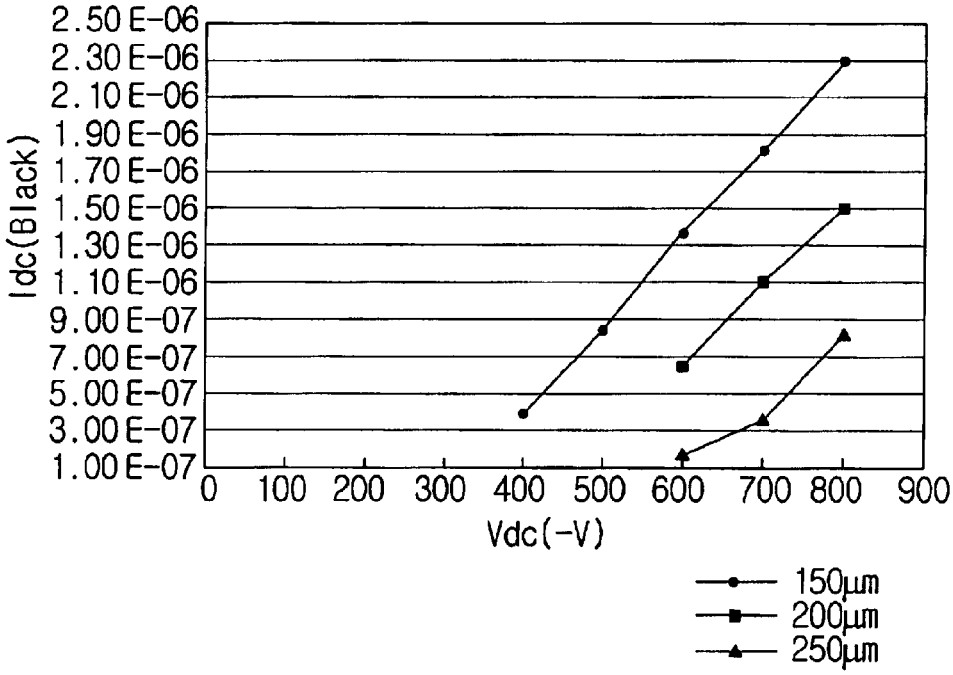
FIG. 5 is a graph representing current variations corresponding to the developing gap.

FIG. 5 is a graph representing current variations corresponding to the developing gap. FIG. 5 shows a result of measuring a DC current in a case of forming a electrostatic latent image or electrostatic latent images with black solid lines in an area corresponding to 2 OPC periods (2/3 area of A4 paper) and supplying a DC voltage to a developer conveyer 5 (developing roller) of FIG. 6 when the developing gap is changed to 250 μm, 200 μm and 150 μm, respectively. Referring to the graph of FIG. 5, when Vdc=−700V is supplied to the developer conveyer 5, current values corresponding to the respective sizes of the developing gap vary as shown in table 1 below. By detecting the developing current, it is also possible to accurately recognize the size of the developing gap.

TABLE 1

| Developing gap (μm) | 250 | 200 | 150 |
|---|---|---|---|
| Developing current (μA) | 0.32 | 1.10 | 1.80 |

Figure 6:
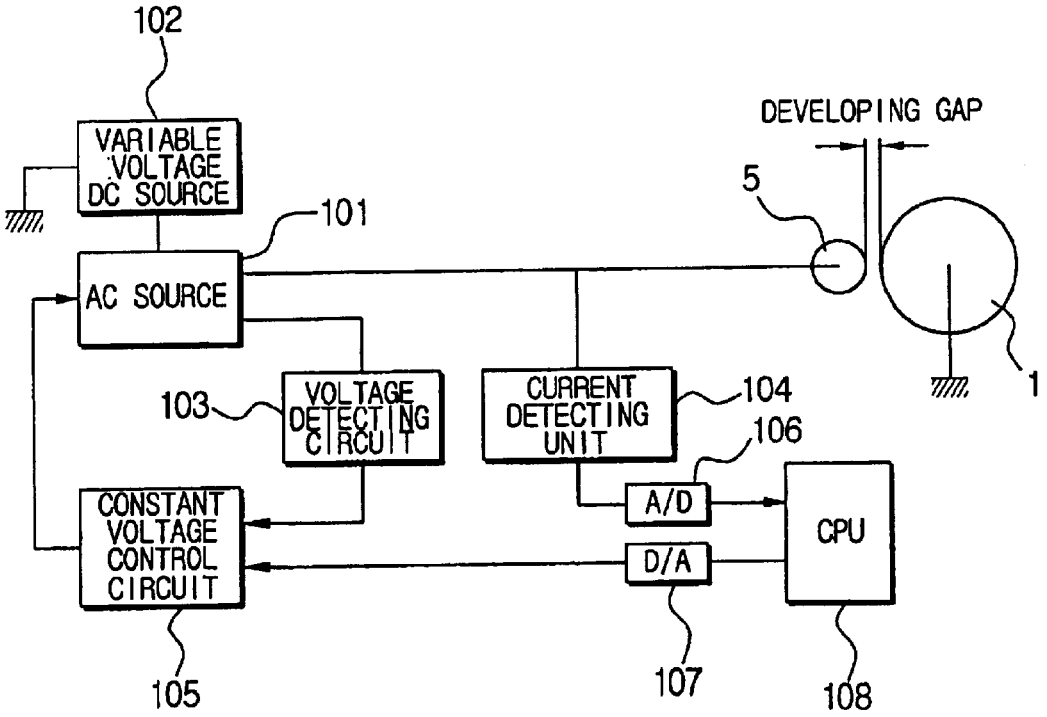
FIG. 6 is a block diagram of an image forming apparatus with a developing gap detecting device having a developing gap detecting function according to an embodiment of the present invention.

FIG. 6 is a block diagram of an image forming apparatus with a gap detecting device having a developing gap detecting function according to an embodiment of the present invention.

As shown in FIG. 6, the image forming apparatus includes a variable voltage AC power source 101, a variable voltage DC power source 102, a voltage detecting circuit 103, a current detecting unit 104, a constant voltage control circuit 105, an A/D converter 106, a D/A converter 107 and a CPU 108.

By turning on a main motor (not shown) of the image forming apparatus, a rotation of 360 of a photosensitive drum 1 is started, and a surface of the photosensitive drum 1 is charged to a voltage level of −700V.

After a desired area of the electrostatic latent image is formed on the photosensitive drum 1, a predetermined voltage is supplied to the developing roller 5. At this time, only a DC voltage can be supplied from the variable voltage DC power source 102 to the developing roller 5, or an overlapped voltage of the DC voltage and an AC voltage outputted from the variable voltage DC power source 102 and the AC power source 101, respectively, can be supplied to the developing roller 5.

The predetermined voltage from the variable voltage DC power source 102 is supplied to the developing roller 5 as described above.

Also, the AC power source may output a square wave having a value of Vpp 1.0~3.0 KV and a frequency of f=1.5~3.0 KHz.

The constant voltage control circuit 105 receives the AC voltage of the AC power source 101 through the voltage detecting circuit 103. Additionally, the constant voltage control circuit 105 feeds-back a value of the AC voltage to the AC power source 101 to maintain the AC voltage value as a target voltage value of developing the electrostatic latent image.

When the electrostatic latent image formed on the photosensitive drum 1 is developed using a developer (toner), a current ldc flows on the developing roller 5 while the toner is moved from the developing roller 5 to the photosensitive drum 1.

The current detecting unit 104 detects this current ldc. A DC current value of the detected current ldc is inputted to the CPU 108 through the A/D converter 106.

The CPU 108 obtains a developing gap based on the inputted DC current value. Also, the CPU 108 calculates a developing voltage value to be supplied to the developing roller 5 based on the obtained developing gap.

At this time, the CPU 108 can calculate a Vo value (that is, developing voltage) using a predetermined function Vo=f (ldc), or set a predetermined table beforehand to obtain the Vo value using a table matching method.

When an image to be printed is outputted, the CPU 108 supplies the obtained Vo value as the overlapped voltage of the DC and AC voltages to the developing roller. Therefore, when the electrostatic latent image is developed, a periodic bias voltage obtained by supplying the constant voltage controlled DC voltage is applied to a sleeve.

Meanwhile, the CPU 108 controls such that the toner image, which is developed on certain area of the photosensitive drum 1 by the developer for the purpose of developing gap detection, is transferred onto a paper sheet. Accordingly, there is no toner image remaining on the photosensitive drum 1 that has to be collected in a waste developer storage (not shown). As a result, the developing gap detection can be performed as many times as necessary. For example, the developing gap detection can be performed when there is a new developing device being mounted, or when the printing is performed on a predetermined number of paper sheets.

Also, the CPU 108 can control the image forming conditions, such as the image density and the line width, through a series of processing.

This controlling of the image forming conditions may be performed by controlling a peak-to-peak, a duty ratio, a frequency, and a DC overlapped value of the AC voltage component of the AC power source, a charged voltage for charging the photosensitive roller, strength of light and a scanning time of an exposure member forming the electrostatic latent image on the photosensitive medium 1 using the light, etc.

The technology for changing the image forming conditions according to the developing voltage is well known in the art and a detailed description thereof will be omitted.

As is apparent from the above description, in accordance with the developing device having the developing gap detecting function of the present invention, the developing gap is detected by sensing the DC current flowing on the developing roller when the charged toner moves from the developing roller to the photosensitive medium. Therefore, it is possible to lower a manufacturing cost, reduce an error, and sense the developing gap minutely, and it is also possible to maintain a density deviation and the line width of the image uniform.

The foregoing embodiment and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An image forming apparatus having a developing gap detecting function, comprising:

a photosensitive medium forming an electrostatic latent image:

a developer conveyer depositing a developer to the electrostatic latent image formed on the photosensitive medium to form a visual image while rotating the photosensitive medium opposite thereto;

a power supply supplying one of DC voltage and the DC voltage overlapped with AC voltage to the developer conveyer;

a current detecting unit detecting a value of a DC current flowing on the developer conveyer when the voltage of the power supply is outputted; and a controller obtaining a developing gap formed between the photosensitive medium and the developer conveyer based on the DC current value detected by the current detecting unit, wherein when the electrostatic latent image formed on the area of the photosensitive medium is developed using the developer transferred from the developer conveyer, the current detecting unit detects the DC current flowing on the developer conveyor.

2. The image forming apparatus of claim 1, further comprising:

a voltage detecting circuit detecting the AC voltage from the DC voltage overlapped with AC voltage; and a constant voltage control circuit which feeds-back a value of the detected AC voltage to the power supply to maintain the value of the detected AC voltage as a target voltage value for developing, wherein the controller controls the constant voltage control circuit to output the developing voltage adapted to the developer conveyer.

3. An image forming apparatus having a developing gap detecting function, comprising:

a photosensitive medium forming an electrostatic latent image;

a developer conveyer depositing a developer to the electrostatic latent image formed on the photosensitive medium to form a visual image while rotating the photosensitive medium opposite thereto;

a power supply supplying one of DC voltage and the DC voltage overlapped with AC voltage to the developer conveyer;

a current detecting unit detecting a value of a DC current flowing on the developer conveyer when the voltage of the power supply is outputted; and a controller obtaining a developing gap formed between the photosensitive medium and the developer conveyer based on the DC current value detected by the current detecting unit, wherein the controller calculates a developing voltage adapted to the developer conveyer based on the obtained developing gap and supplies the developing voltage to the developer conveyer.

4. An image forming apparatus having a developing gap detecting function, comprising:

a photosensitive medium forming an electrostatic latent image;

a developer conveyer depositing a developer to the electrostatic latent image formed on the photosensitive medium to form a visual image while rotating the photosensitive medium opposite thereto;

a power supply supplying one of DC voltage and the DC voltage overlapped with AC voltage to the developer conveyer;

a current detecting unit detecting a value of a DC current flowing on the developer conveyer when the voltage of the power supply is outputted; and a controller obtaining a developing gap formed between the photosensitive medium and the developer conveyer based on the DC current value detected by the current detecting unit, wherein the image forming apparatus comprises an exposure member forming the electrostatic latent image on the photosensitive medium, wherein;

based on the obtained developing voltage, the controller controls image forming conditions including a charged voltage for charging the photosensitive medium and a magnitude of light and a scanning time of the exposure member forming the electrostatic latent image on the photosensitive medium using the light.

5. An image forming apparatus having a developing gap detecting function, comprising:

a photosensitive medium forming an electrostatic latent image;

a developer conveyer depositing a developer to the electrostatic latent image formed on the photosensitive medium to form a visual image while rotating the photosensitive medium opposite thereto;

a power supply supplying one of DC voltage and the DC voltage overlapped with AC voltage to the developer conveyer;

a current detecting unit detecting a value of a DC current flowing on the developer conveyer when the voltage of the power supply is outputted; and a controller obtaining a developing gap formed between the photosensitive medium and the developer conveyer based on the DC current value detected by the current detecting unit, wherein, after the developing gap is obtained, the controller controls such that a toner image, which is developed on certain area of the photosensitive medium by the developing of the electrostatic latent image with the developer for the purpose of obtaining the developing gap, is transferred onto a paper sheet as fed.

6. An image forming apparatus having a developing gap detecting function, comprising:

a photosensitive medium;

an exposure member forming an electrostatic latent image on the photosensitive medium;

a developer conveyer depositing a developer to the electrostatic latent image formed on the photosensitive medium to form a visual image;

a power supply supplying a voltage to the photosensitive medium and the developer conveyer;

a current detecting unit detecting a current flowing from the power supply to the developer conveyer when the voltage of the power supply Is outputted to develop the electrostatic latent image using the developer; and a controller controlling one of a peak-to-peak, a duty ratio, a frequency, and a DC overlapped value of an AC voltage component of the power source to control image forming conditions of the developing device, and adjusting the voltage to charge the photosensitive medium, strength of light and a scanning time of the exposure member forming the electrostatic latent image on the photosensitive medium using the light.

7. An image forming apparatus having a developing gap detecting function, comprising:

a photosensitive medium;

an exposure member forming an electrostatic latent image on the photosensitive medium;

a developer conveyer depositing a developer to the electrostatic latent image formed on the photosensitive medium to form a visual image;

a power supply supplying a voltage to the photosensitive medium and the developer conveyer;

a current detecting unit sensing a DC current flowing on the developer conveyer when a charged developer moves from the developer conveyer to the photosensitive medium; and a controller adjusting the voltage supplied to the developing conveyer using the sensed DC current to maintain a density deviation and a line width of the visual image uniform.

8. A developing gap detecting method in an image forming apparatus having a photosensitive medium and a developer conveyer, the method comprises:

supplying one of DC voltage and the DC voltage overlapped with AC voltage to the photosensitive medium and the developer conveyer;

detecting a value of a DC current flowing on the developer conveyer when a predetermined voltage is outputted to develop an electrostatic latent image formed on an area of the photosensitive medium using a developer transferred from the developer conveyer;

obtaining a developing gap formed between the photosensitive medium and the developer conveyer based on the detected DC current value; and calculating a developing voltage adapted to the developer conveyer to be supplied to the developer conveyer based on the obtained developing gap.

9. A developing gap detecting method in an image forming apparatus having a photosensitive medium and a developer conveyer to form a visual image, the method comprising:

sensing a DC current flowing on the developer conveyer when a charged developer moves from the developer conveyer to the photosensitive medium; and adjusting a charged voltage supplied to the developing roller using the sensed DC current to maintain a density deviation and a line width of the visual image uniform.

10. A developing gap detecting apparatus comprising:

a photosensitive medium forming an electrostatic latent image;

a developer conveyer depositing a developer to the electrostatic latent image formed on the photosensitive medium to form a visual image while rotating the photosensitive medium opposite thereto;

a power supply supplying one of DC voltage and the DC voltage overlapped with AC voltage to the developer conveyer;

a current detecting unit detecting a value of a DC current flowing on the developer conveyer when the voltage of the power supply is outputted; and a controller obtaining a developing gap formed between the photosensitive medium and the developer conveyer based on the DC current value detected by the current detecting unit, wherein when the electrostatic latent image formed on the area of the photosensitive medium is developed using the developer transferred from the developer conveyer, the current detecting unit detects the DC current flowing on the developer conveyor.

11. The developing gap detecting apparatus of claim 10 further comprising:

a voltage detecting circuit detecting the AC voltage from the DC voltage overlapped with AC voltage output from the power supply; and a constant voltage control circuit which feeds-back a value of the detected AC voltage to the power supply to maintain the value of the detected AC voltage as a target voltage value for developing, wherein the controller controls the constant voltage control circuit to output the developing voltage adapted to the developer conveyer.

12. A developing gap detecting apparatus comprising:

a photosensitive medium forming an electrostatic latent image;

a developer conveyer depositing a developer to the electrostatic latent image formed on the photosensitive medium to form a visual image while rotating the photosensitive medium opposite thereto;

a power supply supplying one of DC voltage and the DC voltage overlapped with AC voltage to the developer conveyer;

a current detecting unit detecting a value of a DC current flowing on the developer conveyer when the voltage of the power supply is outputted; and a controller obtaining a developing gap formed between the photosensitive medium and the developer conveyer based on the DC current value detected by the current detecting unit, wherein the controller obtains a developing voltage adapted to the developer conveyer based on the obtained developing gap and supplies the developing voltage to the developer conveyer.

13. A developing gap detecting apparatus comprising:

a photosensitive medium forming an electrostatic latent image;

a developer conveyer depositing a developer to the electrostatic latent image formed on the photosensitive medium to form a visual image while rotating the photosensitive medium opposite thereto;

a power supply supplying one of DC voltage and the DC voltage overlapped with AC voltage to the developer conveyer;

a current detecting unit detecting a value of a DC current flowing on the developer conveyer when the voltage of the power supply is outputted; and a controller obtaining a developing gap formed between the photosensitive medium and the developer conveyer based on the DC current value detected by the current detecting unit, wherein the image forming apparatus comprises an exposure member forming the electrostatic latent image on the photosensitive medium, wherein;

based on the obtained developing voltage, the controller controls image forming conditions including a charged voltage for charging the photosensitive medium and a magnitude of light and a scanning time of the exposure member forming the electrostatic latent image on the photosensitive medium using the light.

14. A developing gap detecting apparatus comprising:

a photosensitive medium forming an electrostatic latent image;

a developer conveyer depositing a developer to the electrostatic latent image formed on the photosensitive medium to form a visual image while rotating the photosensitive medium opposite thereto;

a power supply supplying one of DC voltage and the DC voltage overlapped with AC voltage to the developer conveyer;

a current detecting unit detecting a value of a DC current flowing on the developer conveyer when the voltage of the power supply is outputted; and a controller obtaining a developing gap formed between the photosensitive medium and the developer conveyer based on the DC current value detected by the current detecting unit, wherein, after the developing gap is obtained, the controller controls such that a toner image, which is developed on certain area of the photosensitive medium by the developing of the electrostatic latent image with the developer for the purpose of obtaining the developing gap, is transferred onto a paper sheet as fed.

* * * * *

UNITED STATES PATENT AND TRADEMARK OFFICE

CERTIFICATE OF CORRECTION

PATENT NO. : 7,039,333 B2
APPLICATION NO. : 10/635901
DATED : May 2, 2006
INVENTOR(S) : Ki-jae Do It is certified that error appears in the above-identified patent and that said Letters Patent is hereby corrected as shown below:

Title Page, Item (54) and Col. 1, Line 1, Change "DEVELOPING DEVICE HAVING DEVELOPING GAP DETECTING FUNCTION" to --AN IMAGE FORMING APPARATUS HAVING DEVELOPING GAP DETECTING FUNCTION--.

Column 7, Line 37 after "image" change ":" to --;--.

Column 8, Line 43 after "wherein" change ";" to --:--.

Column 9, Line 21 change "Is" to --is--.

Column 10, Line 33 after "claim 10" insert --,--.

Column 11, Line 20 after "wherein" change ";" to --:--.

Signed and Sealed this

Twenty-first Day of November, 2006

JON W. DUDAS
*Director of the United States Patent and Trademark Office*